United States Patent [19]

Arad et al.

[11] Patent Number: 5,045,015

[45] Date of Patent: Sep. 3, 1991

[54] DOLL HAVING A PAIR OF MECHANICALLY DRIVEN LEGS

[75] Inventors: Avi Arad, Westpoint, Conn.; Janos Beny, Vista; Berne E. Danielson, Pacific Palisades, both of Calif.

[73] Assignee: Tyco Industries, Inc., Mount Laurel, N.J.

[21] Appl. No.: 513,712

[22] Filed: Apr. 24, 1990

[51] Int. Cl.[5] ..... A63H 11/18; A63H 3/46

[52] U.S. Cl. ..... 446/355; 446/378; 446/390; 446/484

[58] Field of Search ..... 446/355, 354, 378, 383, 446/338, 340, 390, 317, 484

[56] References Cited

U.S. PATENT DOCUMENTS

| | | | |
|---|---|---|---|
| 820,843 | 5/1906 | Arnold | 446/338 X |
| 3,456,384 | 7/1969 | Gardel et al. | 446/355 |
| 3,543,435 | 12/1970 | Giroud | 446/355 |
| 3,597,878 | 8/1971 | Iwasaki | 446/355 |
| 4,673,374 | 6/1987 | Kelley | 446/383 |
| 4,878,874 | 11/1989 | Terzian | 446/355 |
| 4,952,189 | 8/1990 | Barlow | 446/241 |

FOREIGN PATENT DOCUMENTS

| | | | |
|---|---|---|---|
| 427570 | 12/1947 | Italy | 446/355 |
| 2163059 | 2/1986 | United Kingdom | 446/355 |

*Primary Examiner*—Mickey Yu

*Attorney, Agent, or Firm*—Panitch, Schwarze, Jacobs & Nadel

[57] ABSTRACT

A doll having a pair of mechanically driven legs for enabling the doll to move over a surface when held in an upright position. The doll includes a body portion for housing and supporting various elements of the doll. A pair of leg members are mounted on the body portion and extend therefrom for movement with respect to the body portion. A drive mechanism is drivingly connected to the leg members for moving the leg members with respect to the body portion and with respect to each other, such that the doll moves over a surface when held in an upright position. The doll includes a pair of feet positioned which are biased such that when the doll moves over a surface only the toe portions of the feet contact the surface. Additionally, the left arm and head member are drivingly connected to the drive mechanism such that when the leg members move, the head member and left arm member pivotally reciprocate with respect to the body portion to provide the doll with a ballerina-like fluidic motion. The right arm includes a switch which is actuated through the elbow joint to change the rotational direction of the leg members so that the doll can be selectively moved forward and rearward over the surface.

8 Claims, 5 Drawing Sheets

FIG.3
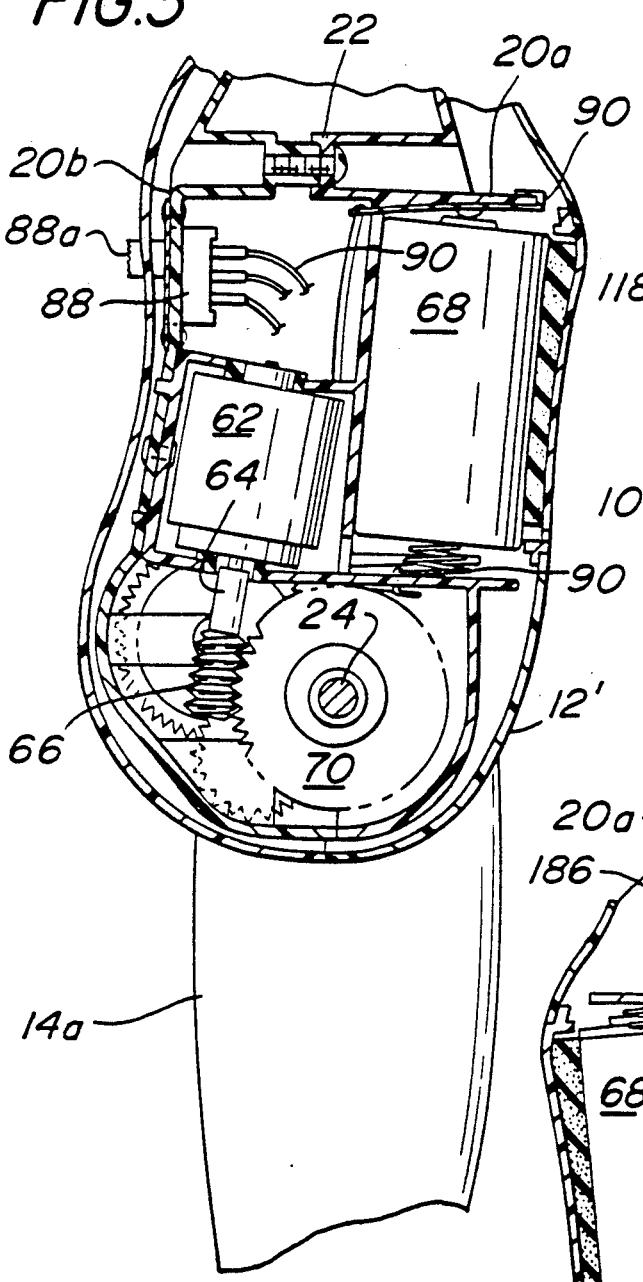
FIG.7
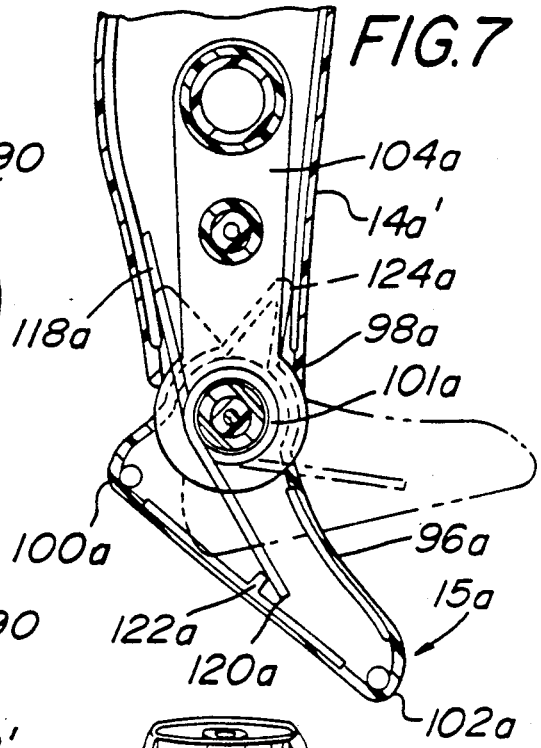
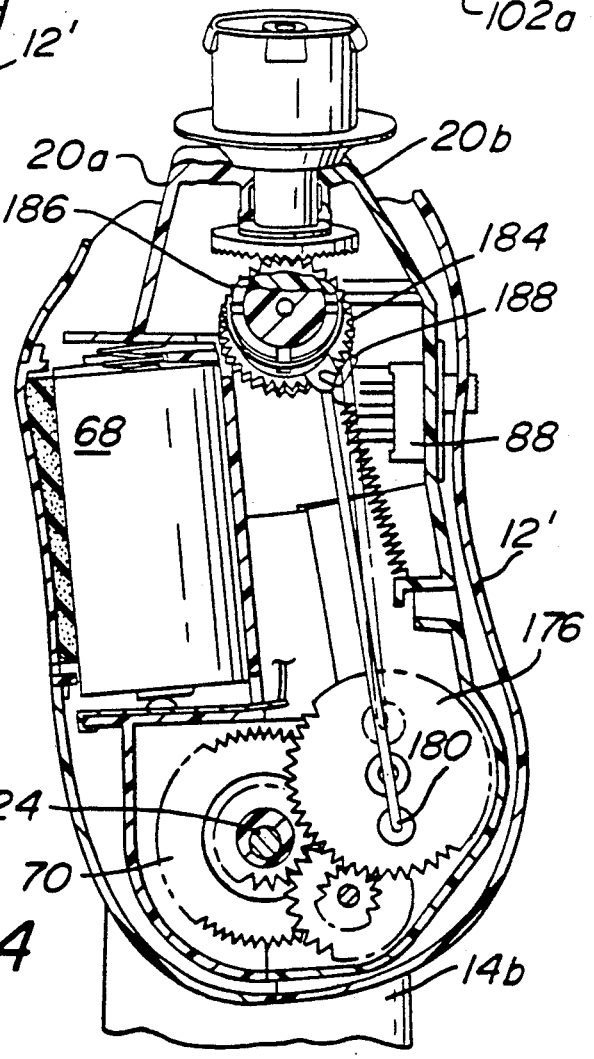
FIG.4

DOLL HAVING A PAIR OF MECHANICALLY DRIVEN LEGS

FIELD OF THE INVENTION

The present invention relates to a mechanical doll and, more particularly, to a ballerina doll having a pair of mechanically driven legs for enabling the doll to move over a surface when held in an upright position.

BACKGROUND OF THE INVENTION

In the toy field, there exists a need for a ballerina doll which has mechanically driven appendages which enable the doll to move over a floor-like surface when held in an upright position. That is, there exists a need for a ballerina doll which when held in an upright position moves across a surface on its tiptoes in a manner similar to that of a real ballerina. Additionally, there exists a need for a ballerina doll wherein the legs, arms and head thereof are drivingly connected together so as to yield a fluidic motion which simulates that of a dancing ballerina.

Such a ballerina doll is preferably an active doll. That is, the owner or user of the doll would have to grasp a portion (e.g., one of the arms) of the doll and position the doll in an upright position such that when the legs are mechanically driven, the doll will traverse a surface with the aid of the user. There also exists a need for enabling the doll to reverse directions when traversing the surface through a switch which can be simply actuated.

The present invention provides a doll having a pair of mechanically driven legs for enabling the doll to move over a surface when held in an upright position. The legs of the doll include feet which have their toe portions biased toward the surface for enabling the doll to traverse the surface on the toe portions in a manner similar to a ballerina. An arm member and a head member are operatively associated with the driving force of the leg members for corresponding fluidic movement therewith much like the mannerisms of a dancing ballerina.

SUMMARY OF THE INVENTION

Briefly stated, the present invention comprises a doll having a pair of mechanically driven legs for enabling the doll to move over a surface when held in an upright position. The doll comprises a body portion for housing and supporting various elements of the doll. A first leg member is mounted on the body portion and extends therefrom for movement with respect thereto. A second leg member is similarly mounted on the body portion and extends therefrom for movement with respect thereto. The body portion includes drive means mounted thereon and drivingly connected to the first and second leg members for moving the first and second leg members with respect to the body portion and with respect to each other such that the doll moves over a surface when held in an upright position.

BRIEF DESCRIPTION OF THE DRAWINGS

The foregoing summary, as well as the following detailed description is better understood when read in conjunction with the appended drawings. For the purpose of illustrating the invention, an embodiment which is presently preferred is shown in the drawings. It is understood, however, that this invention is not limited to the precise arrangements and instrumentalities shown. In the drawings:

FIG. 3 is a cross-sectional view of the doll of FIG. 2 taken along line 3—3 of FIG. 2;

FIG. 4 is an elevational view, partially in cross-section, of the doll of FIG. 2 taken along line 4—4 of FIG. 2;

FIG. 7 is a cross-sectional view of the leg and foot connection shown in FIG. 6 taken along line 7—7 of FIG. 6;

DESCRIPTION OF PREFERRED EMBODIMENT

Figure 1:
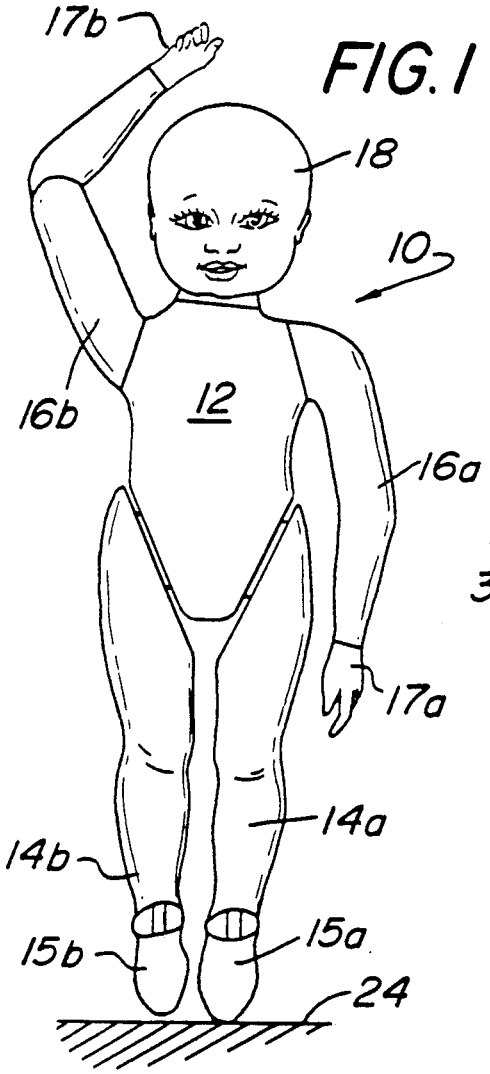
FIG. 1 is an elevational view of an exterior configuration of a doll in accordance with the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the doll and designated parts thereof. The terminology includes the words above specifically mentioned, derivatives thereof and words of similar import.

Referring to the drawings in detail, wherein like numerals indicate like elements throughout, there is shown in FIGS. 1–9 a preferred embodiment of a mechanical ballerina doll in accordance with the present invention. As shown in FIG. 1, the doll, generally designated 10, includes a body or trunk portion 12, a first or left leg member 14*a*, a second or right leg member 14*b*, a first or left arm member 16*a*, a second or right arm member 16*b* and a head member 18. Attached to the distal ends of the first and second leg and arm members are respective first and second foot and hand member 15*a*, 15*b*, 17*a* and 17*b*, described in more detail hereinafter.

While the doll 10 shown if FIG. 1 does not show hair on the head member 18 or clothes on the body portion 12, the head member 18 preferably includes hair which can be configured in a variety of styles which particularly suit the types of styles typically worn by a ballerina. Moreover, the doll 10 preferably includes ballerina type and/or other types of clothes disposed over the exterior of the body portion 12, such as a tutu and tights.

Figure 2:
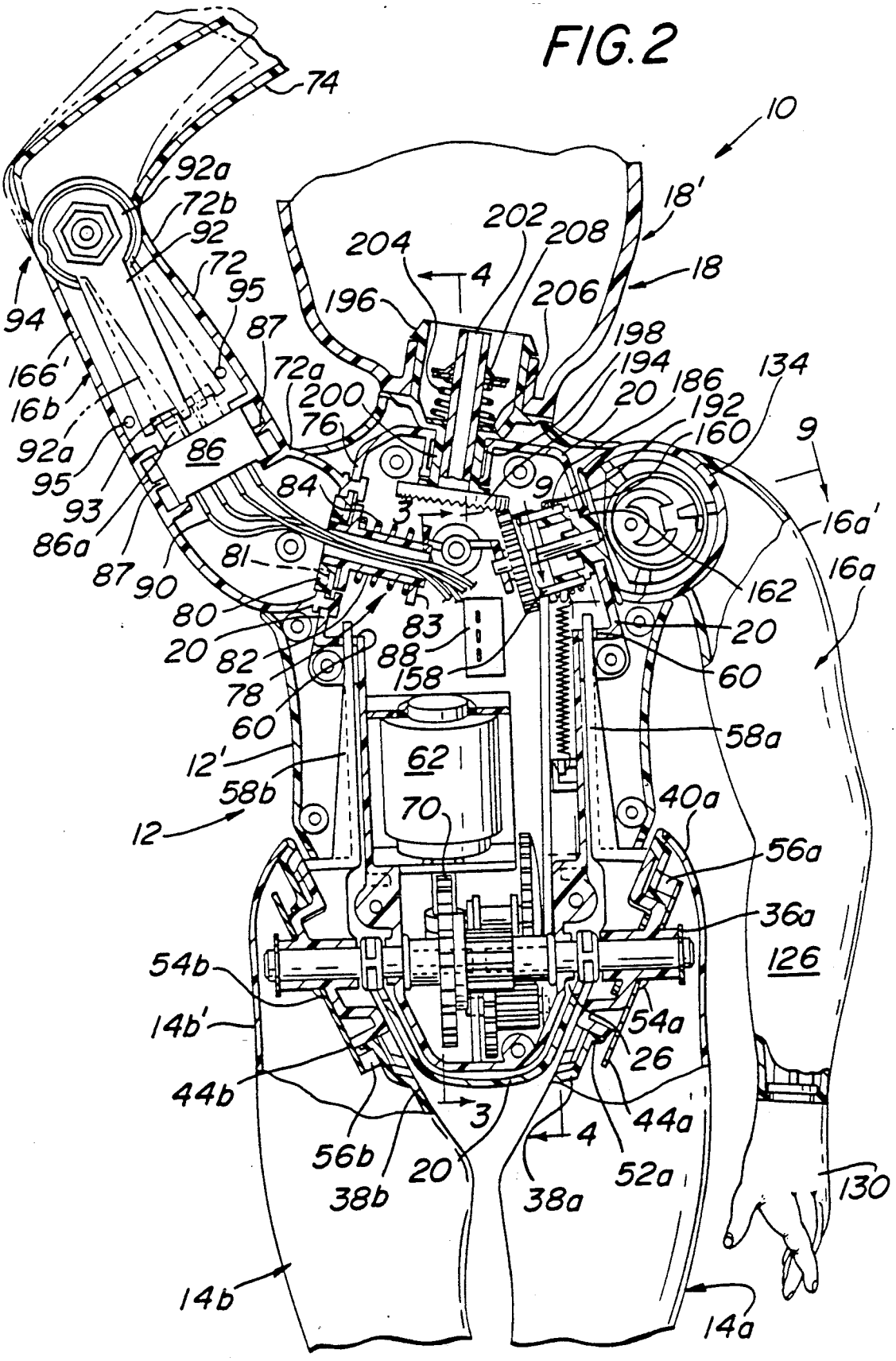
FIG. 2 is an enlarged partial elevational view, partially in cross-section, of a portion of the doll of FIG. 1.

Referring now to FIG. 2, the body portion 12, first leg member 14*a*, second leg member 14*b*, first arm member 16*a*, second arm member 16*b* and head member 18 include shell-like structures designated 12', 14*a'*, 14*b'*, 16*a'*, and 18', respectively, which house various elements for interconnection therebetween and for the operation of the doll 10. In the present embodiment, it is preferred that the body portion, first leg member, second leg member, first arm member and second arm member and head member shell-like structures 12', 14*a'*, 14*b'*, 16*a'*, 16*b'*, and 18' be constructed of a polymeric material. Specifically, it is preferred that the head member 18 be constructed of polyvinylchloride and the remaining of the above-mentioned shell-like structures be constructed of an ABS (acrylonitrile-butadiene-styrene) resin for providing the doll 10 with a tough, rigid thermoplastic exterior. However, it is understood by those skilled in the art that the above-mentioned elements could be constructed of other polymeric materials or materials having like qualities, such as polystyrene or polycarbonate, without departing from the spirit and scope of the invention.

Preferably, the shell-like structures of the body portion 12, first leg member 14*a*, second leg member 14*b*, first arm member 16*a*, second arm member 16*b* and head member 18 are formed by a standard molding process as is understood by those skilled in the art. However, it is also understood by those skilled in the art that other methods and processes could be used to construct the shell-like structures of the doll 10, such as machining.

Referring now to FIGS. 2 through 4, the body portion 12 houses and supports various elements of the doll 10. Positioned within the body portion 12, specifically the shell-like structure 12', is a frame member 20 having a front portion 20*a* and a back portion 20*b*. The front portion 20*a* compliments the back portion 20*b* and is connected thereto by screw means. As shown in FIG. 3, the screw means preferably comprises at least one screw 22 which is disposed through an opening in the front portion 20*a* into a threaded bore in the back portion 20*b*, to thereby secure the front portion 20*a* to the back portion 20*b*, as is understood by those skilled in the art. In the present embodiment, it is preferred that the frame member 20 be constructed of the same material as the body portion shell-like structure 12'. Further details of the frame member 20 are described hereinafter in conjunction with the various elements which are supported thereon.

Generally, the first leg member 14*a* and the second leg member 14*b* are mounted on the body portion 12 and extend therefrom for movement with respect thereto. Means is mounted on the body portion 12 and drivingly connected to the first and second leg members 14*a*, 14*b* for moving the first and second leg members 14*a*, 14*b* with respect to the body portion 12 and with respect to each other such that the doll 10 moves over a surface 25 when held in an upright position, as described in more detail hereinafter.

Referring now to FIG. 2, the means mounted on the body portion 12 and drivingly connected to the first and second leg members 14*a* and 14*b*, comprises a drive shaft, generally designated 24, rotatably supported on the body portion 12 and drive means drivingly connected to the drive shaft 24 for rotation thereof to thereby move the first and second leg members 14*a* and 14*b* with respect to the body portion 12 and each other. Specifically, the drive shaft 24 is rotatably mounted on the frame member 20 in suitably sized generally circular openings 26 therein.

Figure 5:
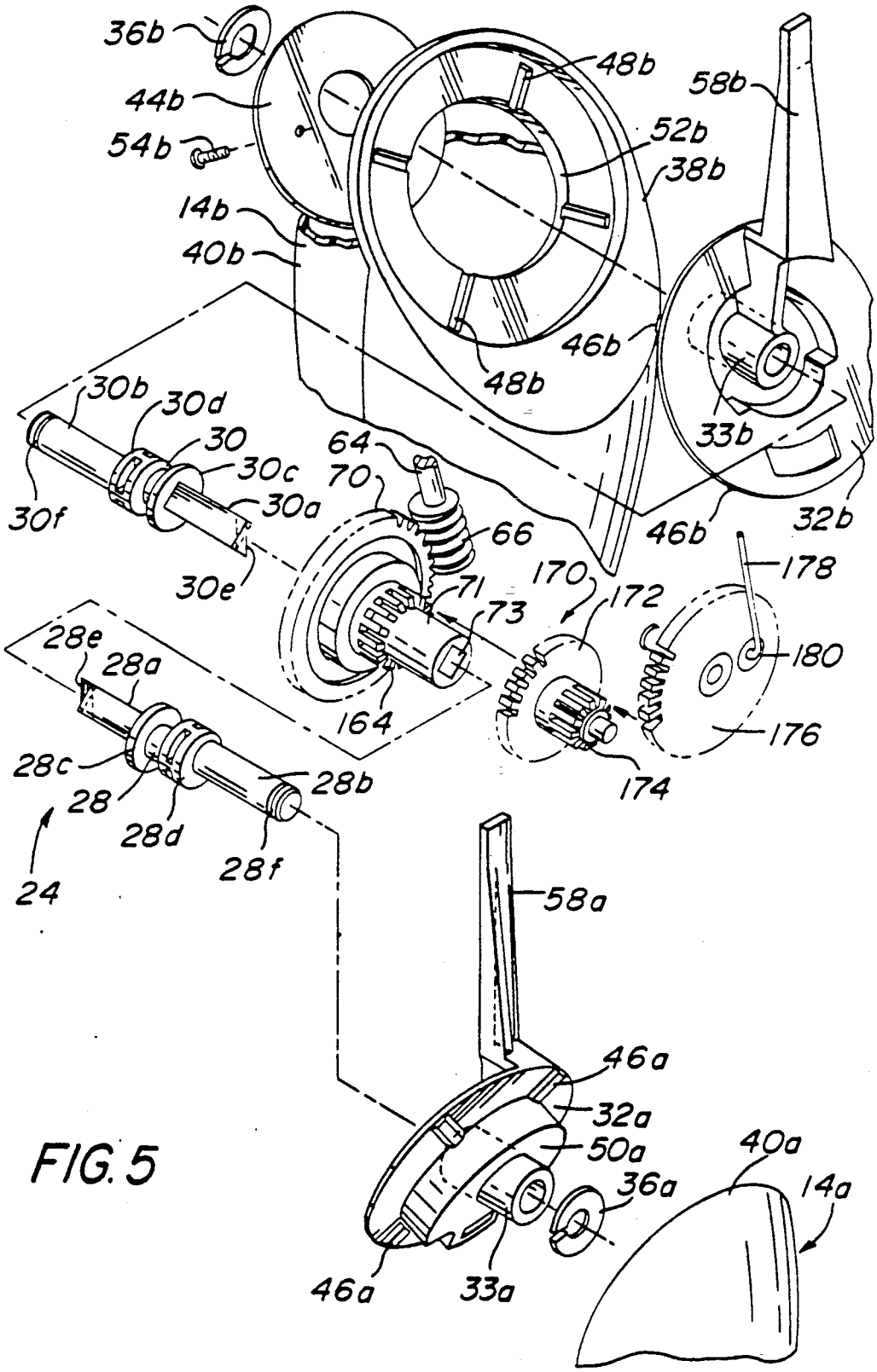
FIG. 5 is a greatly enlarged exploded perspective view of the legs and drive shaft mechanism of the doll of FIG. 1.

Referring now to FIGS. 2 and 5, in the present embodiment, it is preferred that the drive shaft 24 be comprised of a first shaft 28 and a second shaft 30. The first shaft 28, like the drive shaft 24, is rotatably supported on the frame member 20, but axially fixed thereto. The first shaft 28 includes a first end portion 28*a* having a longitudinal axis and a second end portion 28*b* having a longitudinal axis. The longitudinal axis of the first end portion 28*a* is offset and generally parallel to the longitudinal axis of the second end portion 28*b*, as shown in FIG. 5. The first shaft 28 includes an interior radially extending flange 28*c* positioned on the first end portion 28*a* which is spaced apart from an exterior radially extending flange 28*d* positioned on the second end portion 28*b*. The interior flange 28*c* is located on the interior of the frame member 20*b* and the exterior flange 28*d* is located on the exterior of the frame member 20 so as to axially lock the first shaft 28 to the frame member 20 therebetween.

As best shown in FIG. 5, the second end portion 28*b* is generally circular in cross-section whereas the first end portion 28*a* is generally square in cross-section, for reasons which will become apparent from the description hereinafter. The first end portion 28*a* preferably includes a keyed end 28*e* which has approximately ½ the cross-sectional area than the remaining length of the first end portion 28*a*. The keyed end 28*e* is preferably configured to match a similar keyed end 30*e* on the first end portion 30*a* of the second shaft 30 so that the first and second shafts 28 and 30 rotate together.

In the present embodiment, it is preferred that the first and second shafts 28, 30 be constructed of a high strength lightweight material, such as steel. However, it is understood by those skilled in the art, that the first and second shafts 28, 30 could be constructed of other suitable materials having like qualities, such as aluminum or delron, nylon and hard plastics.

The first leg member 14*a* is rotatably mounted on the second end portion 28*b* of the first shaft 28 and fixed axially with respect thereto. The first leg member 14*a* includes a hip portion 32*a* which is generally disk-shaped and includes a generally horizontally extending collar 33*a* for rotatably receiving the second end portion 28*b* therethrough. That is, the interior diameter of the collar 33*a* and the diameter of the second end portion 28*b*, are suitably sized for allowing the hip portion 32*a* to rotate with respect to the second end portion 28*b*. At the outer end of the second end portion 28*b* is an endless groove 28*f* for securably receiving a washer-like clip 36*a* therein after the second end portion 28*b* has been positioned through the hip portion 32*a* to thereby axially secure the hip portion 32*a* to the second end portion, as shown in FIG. 2.

Figure 6:
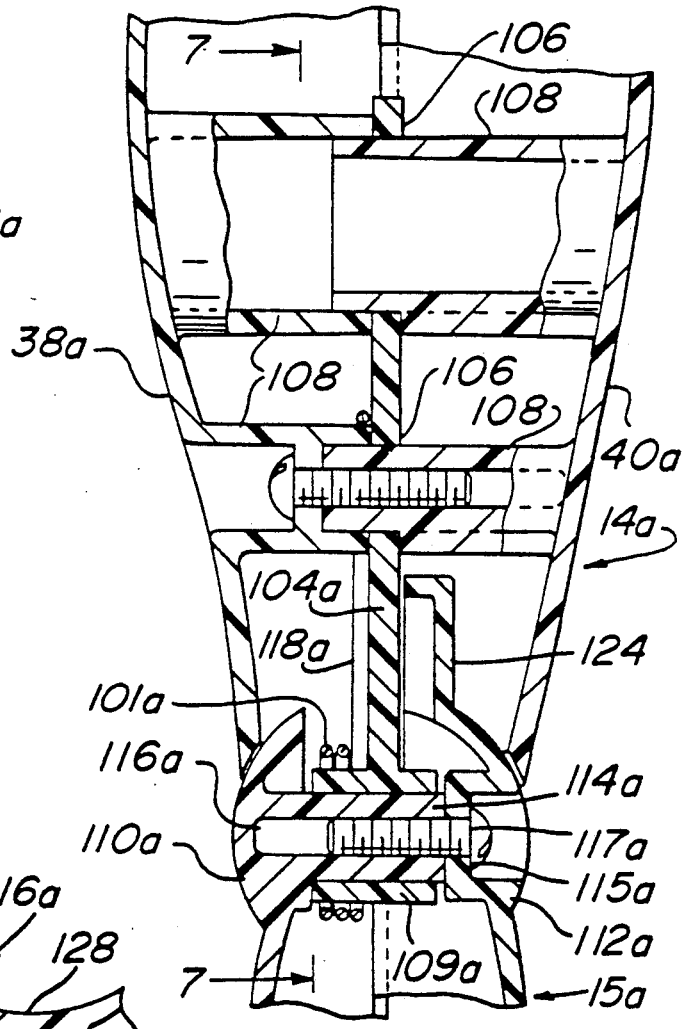
FIG. 6 is a greatly enlarged cross-sectional view of the leg and foot connection of the doll of FIG. 1.

Referring now to FIGS. 2, 5 and 6, the shell-like structure 14*a'*, of the first leg member 14*a* is comprised of an inner shell 38*a* and an outer shell 40*a*. The inner shell 38*a* and outer shell 40*a* are preferably suitably sized to compliment each other to form the leg of a ballerina and are held together by a suitably cooperating screw 42. However, it is understood by those skilled in the art, that the inner shell 38*a* and the outer shell 40*a* could be held together by other means, such as adhesives or through a snap fit, without departing from the spirit and scope of the invention.

Portions of the following description of the first leg member 14*a* are not shown in the drawings, but are shown in conjunction with the generally identical second leg member 14*b*, and indicated with like numerals. The first leg member 14*a* or inner shell 38*a* is held to the hip portion 32*a* by a washer-like element 44*a*. The hip portion 32*a* includes four radially extending rib-like fingers 46*a* which are spaced equidistantly about the periphery of the hip portion 32*a*. The fingers 46*a* cooperate with correspondingly sized and positioned notches (see 48*b*) located on the portion of the inner shell 38*a* which engages the hip portion 32*a*. The hip portion 32*a* includes a generally circular shoulder area 50*a* which is rotatably positioned within a correspondingly sized generally circular aperture 52*a* of the inner shell 38a for allowing the first leg member 14a to rotate with respect to the hip portion 32a. As mentioned above, the inner shell 38a is fixed to the hip portion 32a by the washer-like element 44a positioned between the inner shell 38a and the outer shell 40a and secured to the shoulder area 50a by a fastener or screw 54a.

Interposed between the washer-like element 44a and the inner shell 38a is a generally annular detent spring 56a which biases the notches 48a of the inner shell 38a into engagement with the radially extending fingers 46a of the hip portion 32. Accordingly, the first leg member 14a is rotatable with respect to the hip portion 32a, and yet has four semi-locked positions which allow the first leg member 14a to be partially rotatably secured to the hip portion 32a in four positions.

While in the present embodiment, it is preferred that the hip portion 32a have four radially extending fingers 46a and the inner shell 38a have a corresponding amount of notches 48a, it is understood by those skilled in the art, that any number of notches and fingers could be used and spaced about the inner shell 38a and hip portion 32a without departing from the spirit and scope of the invention. Similarly, it is also understood by those skilled in the art, that the inner shell 38a could be frictionally secured over the shoulder portion 50a to allow the first leg member 14a to assume an infinite number of semi-locked positions with respect to the body portion 12.

Referring now to FIGS. 2 and 5, a guide means is interconnected between each of the first and second leg members 14a, 14b and the body portion 12 for limiting the movement of the first and second leg members 14a, 14b with respect to the body portion 12. In the present embodiment, it is preferred that the guide means be comprised of a finger 58a extending generally vertically from the hip portion 32a into a slot 60 in the frame member 20. The finger 58a reciprocates within the slot 60 when the first drive shaft 28 is rotated with respect to the body portion 20 for preventing the hip portion 32a from rotating with respect to the body portion 12 and yet allowing the hip portion 32a to rotatably receive the second end portion 28b of the first shaft 28.

To assemble the first leg member 14a on the body portion 12, the hip portion 32a is slidably disposed over the second end portion 28b of the first shaft 28 and secured in place with the clip 36a. The aperture 52a of the inner shell 38a is positioned over the shoulder 50a of hip portion 32a. The washer-like element 44a is then disposed over the collar 33a with the detent spring 56a interposed between the washer-like element 44a and the inner shell 38a and secured in that position by the screw 54a. The outer shell 40a is then secured to the inner shell 38a by the screw 42, as shown in FIG. 6.

As shown in FIG. 2, the second shaft 30 is rotatably supported on the body portion 12. Specifically, the second shaft 30 is rotatably mounted on the frame member 20 in the opening 26 in a manner generally identical to the first shaft 28. The second shaft 30 has a first end portion 30a having a longitudinal axis and a second end portion 30b having a longitudinal axis. The longitudinal axis of the first end portion 30a is offset and generally parallel to the longitudinal axis of the second end portion 30b. The first shaft 28 and the second shaft 30 are mounted on the body portion 12, more specifically the frame member 20, such that the longitudinal axis of the first end portion 28a of the first shaft 28 and the longitudinal axis of the first end portion 30a of the second shaft 30 are generally aligned. Furthermore, the longitudinal axis of the second end portion 28b of the first shaft 28 is positioned on one side of the longitudinal axes of the first end portions 28a, 30a, and the longitudinal axis of the second end portion 30b of the second shaft 30 is positioned on the other side of the longitudinal axes of the first end portions 28a, 30a.

The second leg member 14b is preferably rotatably mounted on the second end portion 30b of the second shaft 30 and is fixed axially with respect thereto in a manner similar to that described above in connection with the first leg member 14a. In fact, the above description in connection with the first leg member 14a is equally applicable to the second leg member 14b as indicated by like element numerals since they are generally identical in all respects except that they are mirror images of each other. Consequently, further description of the second leg member 14b is omitted for convenience purposes only and is not limiting.

Referring now to FIGS. 2–5, a drive means is mounted on the body portion 12 and drivingly connected to the first end portions 28a, 30a of the first and second shafts 28, 30 for rotation thereof whereby the first and second leg members 14a, 14b are driven in the same oscillatory path except out of phase with respect to each other such that the doll 10 moves over the surface 25 when held in an upright position.

In the presently preferred embodiment, the longitudinal axes of the second end portion 28b, 30b of the first and second shafts 28, 30 and the longitudinal axes of the first end portion 28a, 30a of the first and second shafts 28, 30 are generally coplaner such that the first and second leg members 14a, 14b are generally out of phase by 180° when the drive means is actuated.

As shown in FIG. 3, the drive means preferably comprises an electric motor 62 having a driven shaft 64 with a worm gear 66 fixedly secured thereon, as is understood by those skilled in the art. The electric motor 62 is preferably powered by a pair of "C" size 1.5 V batteries 68 juxtapositionally mounted within the frame member 20 in electrical communication therewith.

As best shown in FIGS. 3 and 5, the worm gear 66 is drivingly connected to a wheel gear 70 which is drivingly secured to the first end portions 28a, 30a of the first and second shafts 28, 30 for rotation therewith. The wheel gear 70 is fixedly mounted on an outer drive shaft 71 which includes a longitudinally extending bore 73 therethrough. The longitudinally extending bore 73 is preferably generally square in cross-section and is suitably sized to receive the first end portions 28a, 30a of the first and second shafts 28, 30. As such, when the electric motor 62 is actuated, the driven shaft 64 rotates the worm gear 66, which, in turn, rotates the wheel gear 70 and the first and second shafts 28, 30 therewith, to thereby drive the first and second leg members 14a, 14b.

Referring now to FIG. 2, the second arm member 16b has an upper arm portion 72 pivotally mounted on the body portion 12 and a lower arm portion 74 pivotally mounted on a distal end 72b of the upper arm portion 72 for movement with respect thereto. The upper arm portion 72 includes a proximal end 72a which is pivotally connected to the body portion 12, or specifically, frame member 20. The proximal end 72a includes a generally circular groove 76 which is secured within a correspondingly sized generally circular aperture which is formed by the front and back portions 20a, 20b for allowing the second arm member 16b to rotate with respect to the frame member 20. As shown in FIG. 1, the distal end of the lower arm portion 74 includes a hand 176 snap fit thereon, as is understood by those skilled in the art.

A detent mechanism 78 is secured to the proximal end 72*a* of the upper arm portion 72 for locking the second arm member 16*b* in one of a plurality of semi-locked positions. The detent mechanism 78 comprises a detent member 80 fixedly secured to the proximal end 72*a*. The detent member 80 includes a plurality of radially extending notches (not shown) therein which correspondingly receive a plurality of radially extending fingers 81 in a shoulder member 82 which is biased into engagement with the detent member 80 by the detent spring 84. A support element 83 is attached to the back portion 20*b* of the frame member 20 and is positioned over the shoulder member 82 to fixedly secure the shoulder member 82 to the frame member 20 and to maintain the detent spring 84 in compression.

Specific details of the detent mechanism 78 are understood by those skilled in the art and, furthermore, do not form a material part of the present invention. Thus, further description of the structure and operation of the detent mechanism 78 is neither necessary nor limiting.

The doll 10 further includes switch means mounted thereon for selecting a rotational direction of the first and second shafts 28, 30. That is, the switch means allows the shafts 28 and 30 to be rotated in a first direction such that the doll moves forward over the surface 25 when held in an upright position and a second direction such that the doll moves rearward over the surface 25 when held in an upright position.

In the present embodiment, it is preferred that the switch means be comprised of a three position switch 86, as is understood by those skilled in the art. The three position switch 86 is preferably in electrical communication with the electric motor 62, batteries 68 and a two position on/off switch 88, by suitable wiring and circuitry, generally designated 90, in a manner understood by those skilled in the art.

In the present embodiment, it is preferred that the two position on/off switch 88 be a standard button or toggle-type switch, as is understood by those skilled in the art. As shown in FIG. 3, the on/off switch 88 is fixedly secured to the back portion 20*b* within the frame member 20 and includes a button-like element 88*a* extending through the shell-like structure 12' of the body portion 12 for access by the user. As is understood by those skilled in the art, when the on/off switch 88 is placed in the on position, depending upon the position of the three position switch 86, power may be supplied to the electric motor 62 by the batteries 68. Similarly, when the on/off switch 88 is in the off position, the circuit is disabled and the batteries 68 cannot supply power to the electric motor 62.

As shown in FIG. 2, the three position switch 86 is mounted within the upper arm portion 72. The three position switch 86 is secured within the upper arm portion 72 by ribs 87 which extend inwardly from the shell-like structure 16*b*, of the second arm member 16*b*. The three position switch includes a button-like element 86*a* which is movable between three positions. When the button-like element 86*a* is in the first position (the left-most when viewing FIG. 2) power is supplied to the motor 62 with a first polarity so that the driven shaft 64 rotates in a first direction. When the button-like element 86*a* is in the third position (the right-most when viewing FIG. 2), power is supplied to the motor 62 with a second polarity so that the driven shaft 64 rotates in a second or opposite direction. Since the rotational direction of the driven shaft 64 can be reversed in this manner, the doll 10 can move across the surface 25 in two directions when it is held in an upright position by merely moving the button-like element to either the first or the third position.

In the second position in which the button-like element 86 is located between the first position and the third position, the electric motor 62 does not receive power even if the on/off switch 88 is in the on position. Thus, the driven shaft 64 is not rotating and the legs do not move. Thus, the three position switch 86 affects the rotational direction of the driven shaft 64 only when the on/off switch 88 is in the on position.

Connection means are interconnected between the three position switch 86 and the lower arm portion 74 for moving the three position switch 86, specifically the button-like element 86*a*, between the first, second and third positions based upon the position of the lower arm portion 74. When the lower arm portion 74 is in a first position, as shown in FIG. 2, with respect to the upper arm portion 72, the three position switch 86 is in the first position and the driven shaft 64 rotates in the first direction. When the lower arm portion 74 is in a third position with respect to the upper arm portion 72 (shown in phantom), the three position switch 86, specifically the button-like element 86*a*, is in the third position and the driven shaft 64 rotates in the second or opposite direction. Similarly, when the lower arm portion 74 is in a second position with respect to the upper arm portion 72 (shown in phantom), the button-like element 86*a* of the three position switch 86 is in the second position and the driven shaft 64 is not driven or rotating.

In the present embodiment, it is preferred that the connection means be comprised of a lever arm 92 extending between the pivot connection 94 of the upper and lower arm portions 72, 74 and the button-like element 86*a* of the three position switch 86. Preferably, the lever arm 92 includes a first end 92*a* and a second end 92*b*. The first end 92*a* is fixedly secured to the lower arm portion 74 at its pivot point for rotation therewith when the lower arm portion 74 moves with respect to the upper arm portion 72. The specific details of the pivot connection 94 and the first end 92*a* of the lever arm 92 are within the ambit of one ordinarily skilled in the art and, therefore, further description thereof is not believed to be necessary. However, suffice it to say that the first end portion 92*a* of the lever arm 92 includes a generally hexagonal aperture for receiving a suitably sized extension of the lower arm portion 74 so that the lever arm 92 rotates therewith.

The second end 92*b* of the lever arm 92 includes a notch 93 for receiving the button-like element 86*a* therein, as shown in FIG. 2. Thus, as the lower arm portion 74 moves with respect to the upper arm portion 72, the lever arm 92 rotates therewith to thereby move the button-like element 86*a* between the first, second and third positions. As shown in FIG. 2, a pair of pins 95 are located on the lateral sides of the lever arm 92 proximate the three position switch 86 for limiting the movement of the lever arm 92 to limit the relative pivotal motion of the lower arm portion 74 with respect to the upper arm portion 72.

Referring now to FIGS. 6 and 7, there is shown a first foot member 15*a* pivotably mounted on a distal end 98*a* of the first leg member 14*a*. As shown in FIG. 7, the first foot member 15*a* has a heel portion 100*a* and a toe portion 102*a*. First biasing means are provided for biasing the toe portion 102*a* away from the distal end 98*a* of the first leg member 14*a*. The second leg member 14*b* similarly includes a generally identical second foot member 15*b*, having a heel portion, a toe portion and second biasing means (not shown), as described above. The biasing means preferably biases each of the toe portions away from the distal ends of the first and second leg members, such that when the doll 10 is in the upright position and moving along the surface 25 only the toe portions of the first and second foot members 15*a*, 15*b* contact face 25 in a manner similar to that of a dancing ballerina.

As shown in FIG. 7, in the present embodiment, it is preferred that the first biasing means be comprised of a coil spring 101*a* interconnected between the first foot member 15*a* and the first leg member 14*a*. The second biasing means similarly comprises a coil spring interconnected between the second foot member 15*b* and the second leg member 14*b*.

As shown in FIGS. 6 and 7, an ankle strap 104*a* is securely positioned between the inner shell 38*a* and the outer shell 40*a* of the first leg member 14*a*. Specifically, the ankle strap 104*a* includes a pair of apertures 106 for receiving a pair of cooperating beams 108 which extend inwardly and horizontally from each of the inner shell 38*a* and the outer shell 40*a* for fixing and aligning the ankle strap 104*a* with respect to the distal end 98*a* of the first leg member 15*a*, as shown in FIG. 6. The distal end of the ankle strap 104 includes a generally horizontally extending collar 109*a* positioned just beyond the distal end 98*a* of the first leg member 14*a*. In the present embodiment, it is preferred that the collar 109*a* be generally annular in cross section. The collar 109*a* supports the first foot member 15*a* thereon along with the coil spring 101*a*.

Referring now to FIG. 6, the first foot member 15*a* includes an inner half 110*a* and an outer half 112*a* which are secured together. The inner half 110*a* includes a boss 114*a* extending through the collar 109*a*. The boss 114*a* is preferably sized to complement the inner diameter of the collar 109*a* so as to allow the first foot member 15*a* to rotate with respect thereto. The boss 114*a* includes a generally horizontally extending threaded bore 116*a*. The outer half 112*a* includes a aperture 115*a* therein with a suitably sized screw 117*a* extending therethrough which is threadably positioned within the bore 116*a* to thereby secure the inner half 110*a* to the outer half 112*a* and thereby assemble the first foot member 15*a*.

As shown in FIG. 7, the coil spring 101*a* is centrally disposed over the collar 109*a* and includes a first extension 118*a* extending into the interior area of the first leg member 14*a* and a second extension 120*a* extending into the first foot member 15*a*. The second extension 120*a* is in engagement with a rib 122*a* extending upwardly from the bottom of the first foot member 15*a*.

As best shown in FIG. 7, the outer half 112*a* of the first foot member 15*a* includes a stop member 124*a* extending into the first leg member 14*a*. The stop member 124*a* limits the rotational movement of the first foot member 15*a* with respect to the first leg member 14*a* between a first position (shown in phantom) and a second position (as shown in FIG. 7).

In the present embodiment, it is preferred that the coil spring 101*a* have sufficient strength to maintain the toe portion 102*a* biased away from the distal end 98*a* of the first leg member 14*a* when the doll 10 is held in the upright position so that when the doll traverses the surface 25 only the toe portions 102*a* and 102*b* of the first and second foot members 15*a*, 15*b* contact the surface 25. It is further preferred that the coil spring 101*a* have sufficient strength such that when the doll 10 is pushed downwardly the feet 15*a*, 15*b* flatly engage the surface 25 and when the doll 10 is released the doll 10 springs upwardly onto the toe portions 102*a* and 102*b*. However, it is understood by those skilled in the art, that the means for biasing the toe portion 102*a* away from the distal end 98*a* of the first leg member 14*a* could be comprised of other structural elements, such as a leaf spring.

Figure 9:
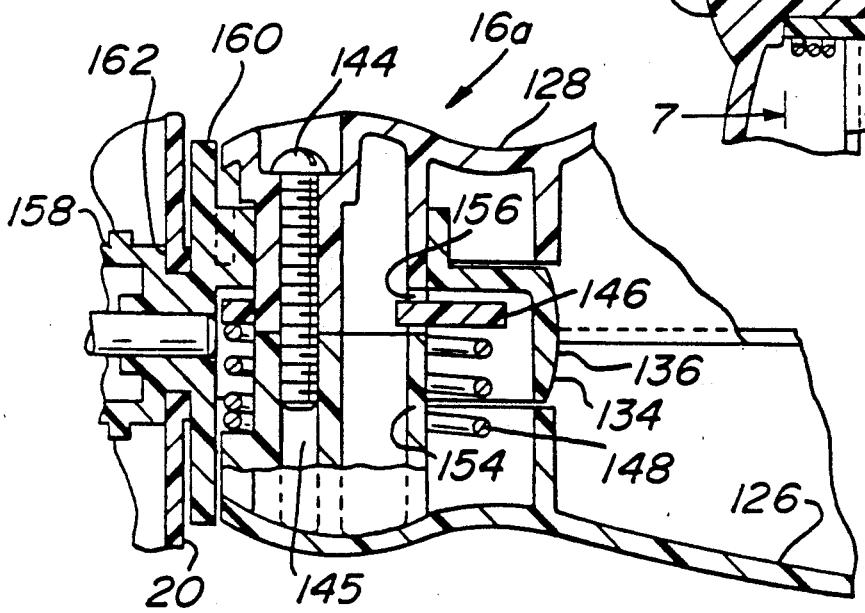
FIG. 9 is a greatly enlarged cross-sectional view of the left shoulder shown in FIG. 2 taken along lines 9—9 of FIG. 2.
Figure 8:
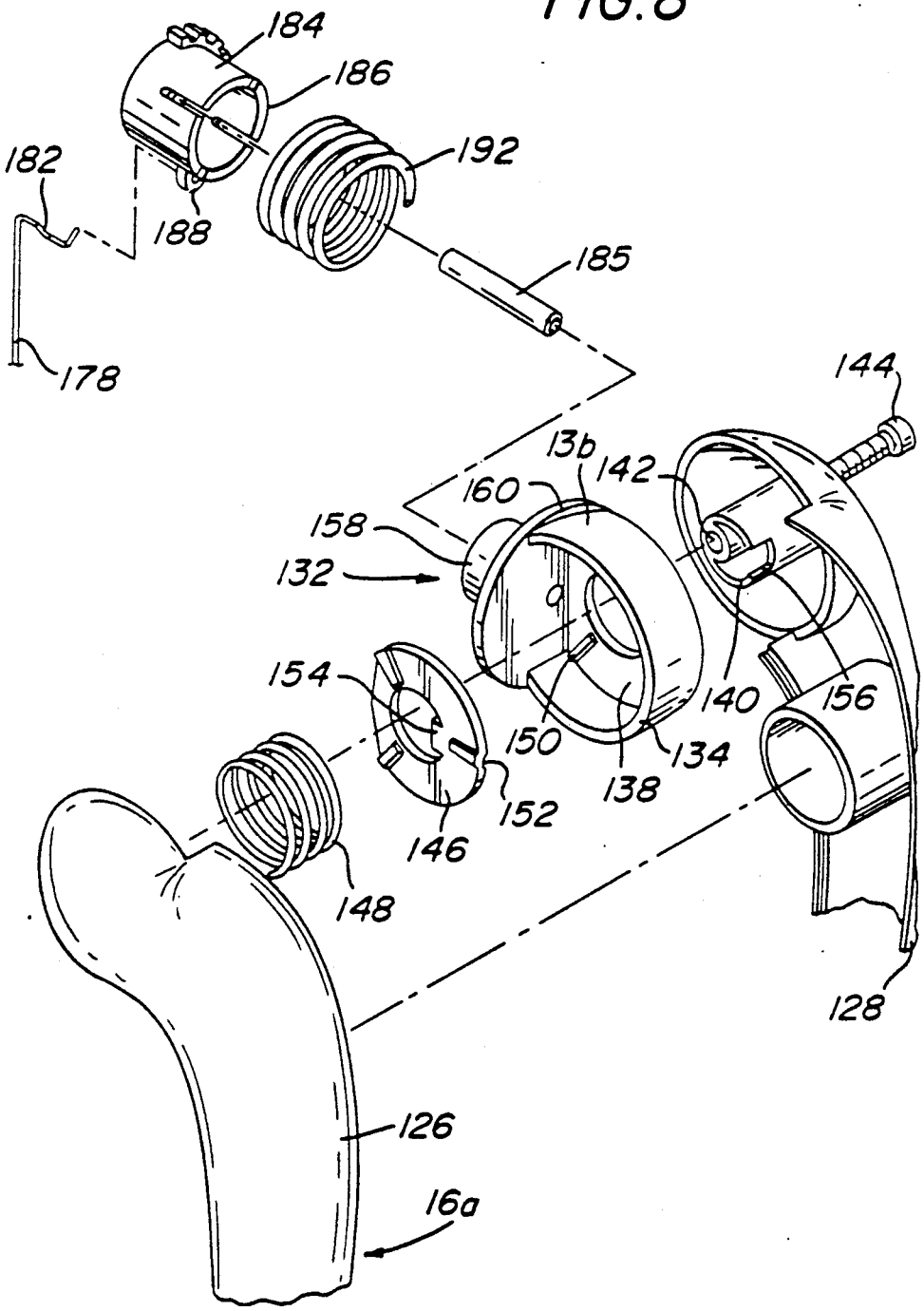
FIG. 8 is a greatly enlarged exploded perspective view of the doll's left shoulder shown in FIG. 2.

Referring now to FIGS. 2, 8 and 9, the first arm member 16*a* is pivotably mounted on the body portion 12. In the present embodiment, it is preferred that the first arm member 16*a* be pivotably mounted on the body portion 12 to allow two degrees of freedom. That is, the first arm member 16*a* can move with respect to the body portion 12 in generally the same manner that a real human arm can move with respect to the human body, except that the elbow joint of the first arm member 16*a* is not flexible or pivotable.

Referring now to FIG. 8, the first arm member 16*a* is comprised of a front half 126 and a back half 128. The front half 126 and back half 128 are correspondingly and suitably sized to form the shape of a typical ballerina's arm when they are secured together, as shown in FIG. 2. The distal end of the first arm member 16*a* includes a hand 17*a* snap-fit thereon, as is understood by those skilled in the art.

As shown in FIG. 8, a pivot joint 132 is located between the front half 126 and back half 128 at the proximal end of the first arm member 16*a*. The pivot joint 132 includes 134 which includes a generally semi-cylindrical portion or surface 136 extending outwardly from a back plate 160 which forms part of the external area of the left shoulder of the doll 10. The arm socket 134 further includes a bulkhead 138 extending across the internal cross-sectional area of the semi-cylindrical surface 136 having a generally circular aperture therethrough for receiving a correspondingly sized mounting pin 140 extending from the back half 128.

The mounting pin 140 includes a bore 142 for receiving a screw 144 or the like therethrough. The screw 144 extends through the bore 142 and is threadably engaged to a correspondingly sized threaded bore 145 in the front half 126 of the first arm member 16*a*, as shown in FIG. 9. Thus, the screw 144 secures the front half 126, arm socket 134 and back half 128 in the assembled form.

As shown in FIGS. 8 and 9, interposed between the bulkhead 138 and the front half 126 is a coil spring 148 and an arm detent 146. The coil spring 148 is positioned to bias the arm detent 146 into a facing engaging relationship with the bulk-head 138.

The arm detent 146 acting in conjunction with the spring 148 allows the first arm member 16*a* to assume three semi-locked positions with respect to the arm socket 134 due to the cooperating fingers 150 and notches 152 extending therebetween, as is understood by those skilled in the art. The arm detent 146 includes a key 154 which cooperates or is inserted in the notch 156 in the mounting pin 140 so that the arm detent 146 is rotatably fixed to the first arm member 16*a*. Thus, when the first arm member 16*a* is assembled in the manner described above, the first arm member 16*a* can move or rotate with respect to the arm socket 134 to thereby achieve one of the degrees of freedom.

Referring now to FIGS. 2 and 9, the arm socket 134 includes a cylindrical or cup-like member 158 extending from the back plate 160 thereof. The cylindrical member 158 is mounted on the back plate 160 such that an endless groove 162 is created therebetween. At the arm socket 134 location, the front portion 20*a* of the frame member 20 and the back portion 20*b* of the frame member 20 form a generally circular aperture and sandwich the arm socket 134 therein at the groove 162. The aperture in the frame member 20 is suitably sized to allow the arm socket 134 to rotate therewithin for allowing the first arm member 16*a* to achieve the second degree of freedom.

Referring now to FIGS. 2–5, linkage means is interconnected between the drive means or electric motor 62 and the first arm member 16*a* for moving the first arm member 16*a* with respect to the body portion 12. In the present embodiment, it is preferred that the linkage means comprise a first gear 164 fixedly secured to the first end portions 28*a*, 30*a* of the first and second shafts 28, 30 for rotation therewith, as shown in FIG. 5. Preferably, the first gear 164 is comprised of a spur gear which is formed as part of the wheel gear 70. The wheel gear 70 and first gear 164 are preferably formed on the shaft 71 which includes the bore 73 extending completely therethrough. As mentioned previously, the bore 73 is generally square in cross-section for receiving the correspondingly sized first end portions 28*a*, 30*a* of the first and second shafts 28, 30 which are also generally square in cross-section.

A compound spur gear 170 is drivingly connected to the first gear 164. That is, the compound spur gear 170 includes a relatively large diameter gear 172 and a relatively small diameter gear 174. The large diameter gear 172 is drivingly intermeshed with the first gear 164, as shown in FIGS. 4 and 5. A second gear 176, in the form of a spur gear, is drivingly connected to the first gear 164 through the compound gear 170. That is, the second gear 176 is drivingly intermeshed with the small diameter gear 174.

When the driven shaft 64 rotates, the worm gear 66 drives or rotates the wheel gear 70 and the first gear 164. The first gear 164 drives the compound gear 170 through the large diameter gear 172 which is fixed to the small gear 174. The small gear 174 in turn drives the second gear 176 at a predetermined ratio.

As shown in FIGS. 4 and 5, a linkage member 178 is interconnected between the second gear 176 and the first arm member 16*a* such that as the second gear 176 rotates, the first arm member pivotably reciprocates. In the present embodiment, it is preferred that the linkage member 178 be comprised of an elongated generally cylindrical rod made of a high strength light weight material, such as steel.

The linkage member 178 has a first end 180 which is securely positioned within an aperture in the second gear 176 so as to allow the second gear 176 to rotate with respect thereto but limit the linkage member 178 from moving axially with respect thereto. The linkage member further includes a second end 182 generally fixedly secured to the first arm member 16*a*. That is, the second end 182 is secured to a drive head gear 184, preferably in the form of a spur gear, having a generally cylindrical portion 186 extending therefrom. The cylindrical portion 186 is positioned over the cylindrical member 158 so as to transfer torque therebetween, as described hereinafter.

As shown in FIG. 2, a pin 185 extends through suitably sized holes in the drive head gear 184 and the cylindrical member 158 for alignment thereof and is secured to the support element 83 to thereby provide structural rigidity to the pivot joint 132. The second end 182 of the linkage member 178 is secured to the cylindrical portion 186 by the tab member 188 extending therefrom (see FIG. 4) for rotation thereof. That is, as the second gear 176 rotates, the tab member 188 moves up and down with the second end 182 of the linkage member 178 to thereby reciprocally and pivotably move the first arm member 16*a*.

Referring now to FIG. 2, a slip clutch 190 is interconnected between the first arm member 16*a* and the linkage means or linkage member 178 for limiting the amount of torque transmitted between the linkage member 178 and the first arm member 16*a*. That is, the slip clutch 190 limits the amount of torque transmitted between the cylindrical portion 186 and the cylindrical member 158 which are suitably sized to accomplish the function set forth below. A clamping spring 192 is positioned around the periphery of the cylindrical portion 186 to clamp the cylindrical portion 186 to the cylindrical member 158 with sufficient force to transfer a predetermined level of torque therebetween, as is understood by those skilled in the art.

Referring now to FIGS. 2, 4 and 8, a gear means is interconnected between the head member 18 and the first arm member 16*a* for moving the head member 18 with respect to the body portion 12 when the first arm member 16*a* moves with respect to the body portion 12, as described above. In the present embodiment, it is preferred that the gear means be comprised of a right angle gear 194 and the drive head gear 184 secured to the first arm member 16*a* for movement therewith as described above. The drive head gear 184 is drivingly connected to the right angle gear 194 which is secured to the head member 18 for rotation thereof when the drive head gear 184 moves with the arm member 16*a*.

Referring now to FIG. 2, the head member 18 is snap fit over a head armature 196. The head armature 196 is rotatably supported within an aperture 198 in the frame member 20. A centrally disposed bore 200 extends through the head armature 196 for receiving a shaft 202 perpendicularly and fixedly connected to the right angle gear 194. The shaft 202 and the bore 200 are suitably sized to allow a semi-friction fit for transferring torque therebetween to a certain maximum level. The shaft 202 and head armature 196 include a washer 206 and a tinnermann clip 208 disposed over the shaft 202 with a coil spring 204 disposed therebetween for securing the right angle gear 194 to the head armature 196, as is understood by those skilled in the art.

The above-described embodiment refers to particular materials which the doll 10 is preferably constructed of, it is understood by those skilled in the art, that the various elements of the doll 10 can be constructed of a plurality of high strength lightweight materials of either the metallic or polymer type. For instance, while it is preferred that the outer shell of the doll 10 be constructed of a polymeric material, it is equally preferred that the drive elements, such as the drive gears, be constructed of a metallic material for providing structural integrity to the transmission system. However, it is understood by those skilled in the art, that other materials can be used to construct the doll 10 without departing from the spirit and scope of the invention.

In use or operation, the user grasps the second arm member 16*b* by the lower arm portion 74 and holds the doll 10 in an upright or stand-up position with the toe portions in contact with the surface 25. Using the button element 88*a*, the on/off switch 88 is placed in the on position and the electric motor 62 is thereby enabled. The driven shaft 64 commences rotating and driving the first shaft 28 and the second shaft 30 through the gears described above such that the first and second leg members 14*a*, 14*b* are driven with respect to each other, but out of phase by 180° so that the doll 10 moves over the surface 25 in a direction depending upon the position of the button-like element 86*a* of the three position switch 86.

If the user desires to change the direction of the doll's movement (i.e., forward or backward), a simple movement of the lower arm portion 74 with respect to the upper arm portion 72 so that the button-like element 86*a* moves through the first position to the third position, the driven shaft 64 rotates in a second or opposite direction to thereby reverse the oscillatory path of the first and second leg members 14*a*, 14*b*. The lower arm portions 74 can be moved by either directly grasping the lower arm portion 74 or by grasping an element, such as a flower, (not shown) in the hand 17*b*. If the three position switch 88 is placed in the second position, the power circuit to the electric motor 62 is interrupted and the doll 10 ceases to operate. Furthermore, the doll 10 can pirouette regardless of the direction in which the doll 10 is traveling.

As the first and second leg members 14*a*, 14*b* are driven in the oscillatory path, the first arm member 16*a* and head member 18 reciprocally pivot due to the linkage means and gear means described above. While the first arm member 16*a* is positioned on the side of the body member 12 in FIG. 2, it is understood by those skilled in the art, that the first arm member 16*a* can assume many positions with respect to the body portion 12 and reciprocally pivot with respect thereto so as to create a ballerina-like fluidic motion.

While the above-described embodiment of the doll 10 is directed to a drive system which utilizes a first shaft 28 and a second shaft 30, it is understood by those skilled in the art that changes may be made to the above-described embodiment of the invention without departing from the broad inventive concept thereof. For instance, the first shaft 28 and second shaft 30 are essentially connected to form a single drive shaft and could easily be manufactured as the same. As such, the drive shaft would have a first outer portion having a longitudinal axis, a second outer portion having a longitudinal axis, and a middle potion therebetween having a longitudinal axis. The longitudinal axis of the first and second outer portions which correspond to the second end portions 28*b*, 30*b* would generally be parallel to and offset a predetermined distance from the longitudinal axis of the middle portion, which would be similar to the first end portions 28*a*, 30*a*. Moreover, the longitudinal axis of the first outer portion would be positioned on one side of the longitudinal axis of the middle portion, and the longitudinal axis of the second outer portion would be positioned on the other side of the longitudinal axis of the middle portion. Consequently, when the electric motor 62 is driven the first and second leg members 14*a*, 14*b* would be driven in the same ocsillatory path as described above.

From the foregoing description, it can be seen that the present invention comprises a doll 10 having a pair of mechanically driven legs for enabling the doll to move over a surface when held in an upright position. It is recognized by those skilled in the art, that changes may be made to the above-described embodiment of the invention without departing from the broad inventive concept thereof. It is understood, therefore, that this invention is not limited to the particular embodiment disclosed, but is intended to cover all modifications which are within the spirit and scope of the invention as defined by the appended claims.

We claim:

1. A doll having a pair of mechanically driven legs for enabling the doll to move over a surface when held in an upright position, said doll comprising:

a body portion for housing and supporting various elements of said doll;

a first leg member mounted on said body portion and extending therefrom for movement with respect thereto;

a first foot member pivotally mounted on a distal end of said first leg member, said first foot member having a heel portion and a toe portion;

biasing means for biasing said toe portion away from said distal end of said first leg member;

a second leg member mounted on said body portion and extending therefrom for movement with respect thereto;

a second foot member pivotally mounted on a distal end of said second leg member, said second foot member having a heel portion and a toe portion;

second biasing means for biasing said second foot member toe portion away from said distal end of said second leg member, whereby when said doll is in said upright position and moving along a surface only said toe portions of said first and second foot members contact said surface;

drive means mounted on said body portion and drivingly connected to said first and second leg members for moving said first and second leg members with respect to said body portion and with respect to each other such that said doll moves over a surface when held in an upright position.

2. The doll as recited in claim 1, wherein said first biasing means is a coil spring interconnected between said first foot member and said first leg member and said second biasing means is a coil spring interconnected between said second foot member and said second leg member.

3. A doll having a pair of mechanically driven legs for enabling the doll to move over a surface when held in an upright position, said doll comprising:

a body portion for housing and supporting various elements of said doll;

a drive shaft rotatably supported on said body portion, said drive shaft having a wheel gear fixedly secured thereto for rotation therewith, a first outer portion having a longitudinal axis, a second outer portion having a longitudinal axis and a middle portion therebetween having a longitudinal axis, said longitudinal axes of said first and second outer portions being generally parallel to and offset a predetermined distance from said longitudinal axis of said middle portion, said longitudinal axis of said first outer portion being positioned on one side of the longitudinal axis of said middle portion, said longitudinal axis of said second outer portion being positioned on the other side of the longitudinal axis of said middle portion;

a first leg member rotatably mounted on said first outer portion of said drive shaft and fixed axially with respect thereto;

a second leg member rotatably mounted on said second outer portion of said drive shaft and fixed axially with respect thereto;

drive means mounted on said body portion comprising an electric motor having a driven shaft with a worm gear fixedly secured thereon, said worm gear being drivingly connected to said wheel gear on said drive shaft for rotation thereof whereby said first and second leg members are driven in the same oscillatory path except out of phase with respect to each other such that said doll moves over a surface when held in an upright position and said drive means is actuated;

a second arm member having an upper arm portion pivotably mounted on said body portion and a lower arm portion pivotably mounted on a distal end of said upper arm portion for movement with respect thereto;

switch means mounted on said upper arm portion and in electrical communication with said electric motor for selecting a rotational direction of said driven shaft; and connection means interconnected between said switch means and said lower arm portion for moving said switch means between a first and second position such that when said lower arm portion is in a first position with respect to said upper arm portion, said switch means is in said first position and said driven shaft rotates in a first direction and when said lower arm portion is in a second position with respect to said upper arm portion, said switch means is in said second position and said driven shaft rotates in a second direction.

4. A doll having a pair of mechanically driven legs for enabling the doll to move over a surface when held in an upright position, said doll comprising:

a body portion for housing and supporting various elements of said doll;

a first shaft rotatably supported on said body portion, said first shaft having a first end portion having a longitudinal axis and a second end portion having a longitudinal axis, said longitudinal axis of said first end portion being offset and generally parallel to said longitudinal axis of second end portion;

a first leg member rotatably mounted on said second end portion of said first shaft and fixed axially with respect thereto;

a second shaft rotatably supported on said body portion, said second shaft having a first end portion having a longitudinal axis and a second end portion having a longitudinal axis, said longitudinal axis of said first end portion being offset and generally parallel to said longitudinal axis of said second end portion, said first shaft and said second shaft being mounted on said body portion such that said longitudinal axis of said first end portion of said first shaft and said longitudinal axis of said first end portion of said second shaft are generally aligned, said longitudinal axis of said second end portion of said first shaft being positioned on one side of the longitudinal axes of said first end portions, said longitudinal axis of said second end portion of said second shaft being positioned on the other side of the longitudinal axes of said first end portions;

a second leg member rotatably mounted on said second end portion of said second shaft and fixed axially with respect thereto;

a wheel gear fixedly secured to said first end portions of said first and second shafts for rotation therewith;

drive means mounted on said body portion comprising an electric motor having a driven shaft with a worm gear fixedly secured thereon, said worm gear being drivingly connected to said wheel gear on said first end portions of said first and second shafts for rotation thereof whereby said first and second leg members are driven in the same oscillatory path except out of phase with respect to each other such that said doll moves over a surface when held in an upright position and said drive means is actuated;

a second arm member having an upper arm portion pivotably mounted on said body portion and a lower arm portion pivotably mounted on a distal end of said upper arm portion for movement with respect thereto;

switch means mounted on said upper arm portion and in electrical communication with said electric motor for selecting a rotational direction of said driven shaft; and connection means interconnected between said switch means and said lower arm portion for moving said switch means between a first and second position such that when said lower arm portion is in a first position with respect to said upper arm portion, said switch means is in said first position and said driven shaft rotates in a first direction, and when said lower arm portion is in a second position with respect to said upper arm portion, said switch means is in said second position and said driven shaft rotates in a second direction.

5. A doll having a pair of mechanically driven legs for enabling the doll to move over a surface when held in an upright position, said doll comprising:

a body portion for housing and supporting various elements of said doll;

a drive shaft rotatably supported on said body portion, said drive shaft having a first outer portion having a longitudinal axis, a second outer portion having a longitudinal axis and a middle portion therebetween having a longitudinal axis, said longitudinal axes of said first and second outer portions being generally parallel to and offset a predetermined distance from said longitudinal axis of said middle portion, said longitudinal axis of said first outer portion being positioned on one side of the longitudinal axis of said middle portion, said longitudinal axis of said second outer portion being positioned on the other side of the longitudinal axis of said middle portion;

a first leg member rotatably mounted on said first outer portion of said drive shaft and fixed axially with respect thereto;

a first foot member pivotally mounted on a distal end of said first leg member, said first foot member having a heel portion and a toe portion;

biasing means for biasing said toe portion away from said distal end of said first leg member;

a second leg member rotatably mounted on said second outer portion of said drive shaft and fixed axially with respect thereto;

a second foot member pivotally mounted on a distal end of said second leg member, said second foot member having a heel portion and a toe portion;

second biasing means for biasing said second foot member toe portion away from said distal end of said second leg member, whereby when said doll is in said upright position and moving along a surface only said toe portions of said first and second foot members contact said surface; and drive means mounted on said body portion and drivingly connected to said drive shaft for rotation thereof whereby said first and second leg members are driven in the same oscillatory path except out of phase with respect to each other such that said doll moves over a surface when held in an upright position and said drive means is actuated.

6. The doll as recited in claim 5, wherein said first biasing means is a coil spring interconnected between said first foot member and said first leg member and said second biasing means is a coil spring interconnected between said second foot member and said second leg member.

7. A doll having a pair of mechanically driven legs for enabling the doll to move over a surface when held in an upright position, said doll comprising:

a body portion for housing and supporting various elements of said doll;

a first shaft rotatably supported on said body portion, said first shaft having a first end portion having a longitudinal axis and a second end portion having a longitudinal axis, said longitudinal axis of said first end portion being offset and generally parallel to said longitudinal axis of said second end portion;

a first leg member rotatably mounted on said second end portion of said first shaft and fixed axially with respect thereto;

a first foot member pivotably mounted on a distal end of said first leg member, said first foot member having a heel portion and a toe portion;

first biasing means for biasing said toe portion away from said distal end of said first leg member;

a second shaft rotatably supported on said body portion, said second shaft having a first end portion having a longitudinal axis and a second end portion having a longitudinal axis, said longitudinal axis of said first end portion being offset and generally parallel to said longitudinal axis of said second end portion, said first shaft and said second shaft being mounted on said body portion such that said longitudinal axis of said first end portion of said first shaft and said longitudinal axis of said first end portion of said second shaft are generally aligned, said longitudinal axis of said second end portion of said first shaft being positioned on one side of the longitudinal axes of said first end portions, said longitudinal axis of said second end portion of said second shaft being positioned on the other side of the longitudinal axes of said first end portions;

a second leg member rotatably mounted on said second end portion of said second shaft and fixed axially with respect thereto;

a second foot member pivotably mounted on a distal end of said second leg member, said second foot member having a heel portion and a toe portion;

second biasing means for biasing said second foot member toe portion away from said distale end of said second leg member, whereby when said doll is in said upright position and moving along a surface only said toe portions of said first and second foot members contact said surface; and drive means mounted on said body portion and drivingly connected to said first end portions of said first and second shafts for rotation thereof whereby said first and second leg members are driven in the same oscillatory path except out of phase with respect to each other such that said doll moves over a surface when held in an upright position and said drive means is actuated.

8. The doll as recited in claim 7, wherein said first biasing means is a coil spring interconnected between said first foot member and said first leg member and said second biasing means is a coil spring interconnected between said second foot member and said second leg member.

* * * * *